United States Patent [19]

Kawamura et al.

[11] Patent Number: 4,679,020

[45] Date of Patent: Jul. 7, 1987

[54] SUPERCONDUCTING SOLENOID AND METHOD OF MAKING SAME

[75] Inventors: Toshimi Kawamura; Takashi Satow, both of Kobe, Japan

[73] Assignee: Mitsubishi Denki Kabushiki Kaisha, Tokyo, Japan

[21] Appl. No.: 867,068

[22] Filed: May 27, 1986

[30] Foreign Application Priority Data

May 31, 1985 [JP] Japan ..... 60-119121

[51] Int. Cl.[4] ..... H01K 7/22

[52] U.S. Cl. ..... 335/216; 335/299; 79/599

[58] Field of Search ..... 335/216, 299, 300; 174/126 S, 128 S; 336/DIG. 1

[56] References Cited

U.S. PATENT DOCUMENTS 3,227,930 1/1966 Hnilicka ..... 335/299 X 3,281,737 10/1966 Swartz ..... 335/299 X

*Primary Examiner*—George Harris

*Attorney, Agent, or Firm*—Leydig, Voit & Mayer

[57] ABSTRACT

A superconducting solenoid and a method of making the same in which the density of the current flowing through the windings can be made a sufficiently high level, and in which the size and the production cost of the solenoid can be reduced as much as possible. The superconducting solenoid comprises: a plurality of coil elements each in the form of a pancake laminated one over another in concentric relation with each other; a plurality of spacers formed of an electrically insulating material and interposed between adjacent coil elements for providing electrical insulation and conduits for a cooling medium; and means for assembling together the laminated coil elements and the spacers. Each of the coil elements includes a winding frame in the form of a cylinder, and filamentary conductors wound around the winding frame and then heat treated, and a supporting structure formed of a resinous material impregnated in between the wound filamentary conductors.

10 Claims, 6 Drawing Figures

SUPERCONDUCTING SOLENOID AND METHOD OF MAKING SAME

BACKGROUND OF THE INVENTION

1. Field of the Invention

The present invention relates to a superconducting solenoid and a method of making the same, and more particularly, to a winding arrangement for such a superconducting solenoid which is capable of improving superconductivity stability, which is of construction sturdy enough to effectively prevent degradation of superconductivity, and in which satisfactory conduits for a cooling medium are ensured.

2. Description of the Prior Art

FIG. 4 is a cross section showing a superconducting solenoid made in accordance with a conventional "wind and react" procedure, which is described in literature such as, for example, in a paper entitled "High-Field Magnet formed of New $Nb_3$ Sn Wires", by Koizumi et al, issued in May 1978 in preparation for the Twentieth Low-Temperature Engineering Conference. In this Figure, a superconducting coil 102 is wound around a coil-winding frame or core 101 in the form of a cylinder. As clearly illustrated in FIGS. 5A and 5B, the superconducting coil 102 is made by winding around the frame 101 wires 103 of filamentary conductors each covered with an electrical insulator 104 formed of a heat-resisting material such as glass fibers, heat treating the wires 103 thus wound around the frame 101 to produce superconductors, and impregnating a resinous material 105 into spaces formed between the windings so as to obtain a sturdy winding construction.

Now, description will be made of the coil-making procedure and the effects resulting therefrom.

In general, superconductors including compounds such as $Nb_3$, $V_3Ga$ or the like are extremely brittle and hence it is difficult to effect winding of wires of such superconductors after they are heat treated to form electric wires. This is because the allowable strain of these superconductors is less than 1 percent, as described in a publication entitled "Proceedings of a NATO Advanced Study Institute on the Science and Technology of Superconducting Materials (1980), page 474. Accordingly, a typical conventional process generally employed is that, as shown in FIG. 5A or 5B, wires 103 formed of metal composites, which do not cause compound-forming reactions, are each enclosed by an insulator 104 of a heat-resisting material and are wound around the coil-winding frame 101. As the insulator 104, it is usual to employ fibers of heat-resisting glass of high purity (so-called S glass) so as to give it heat resistivity enough to withstand the heat treatments as described later in detail.

After being wound in the above manner, the wires 103 are placed in a furnace and burned there at about 800° C. so as to form an intermetallic compound, and thus superconductors are obtained which can be put into practical use. The superconductors formed of $Nb_3Sn$ or $V_3Ga$ have a so-called transition temperature of 18° K. or therearound, at which superconductivity is lost, the transition temperature being higher than those of other kinds of superconductors. Therefore, it is generally cosidered that stability in superconductivity of the $Nb_3Sn$ or $V_3Ga$ superconductors is extremely high. However, the coil formed of the superconductors thus obtained has a loose structure so that it can not be put into practical use. The reason for this is that with the loose construction of the coil, the windings of wires 103 are permitted to move relative to each other, thereby readily destructing or quenching the superconductivity of the coil particularly under conditions where the stability in superconductivity of the coil is relatively limited. To improve this situation, the coil is carefully treated such that a resinous material is impregnated under vacuum into spaces formed between the windings so as to completely fill the voids around the windings. If this treatment is effected completely, it is possible to increase coil current to the critical level inherent to the superconductors.

With the conventional superconducting solenoid of the so-called "wind and react" type as produced in the above-described manner, cooling of the entire solenoid by means of a cooling medium is insufficient and thus the critical superconducting current of the solenoid, even if equivalent to that obtained with bare wires, is very unstable. In order to improve stability in superconductivity, there is no choice but to either effect satisfactory cooling of the solenoid or to reduce current densities. In this case, however, the requirements of the former choice can not be satisfied and therefore the latter choice has to be made with the result that the size and hence the production cost of the solenoid are considerably increased.

SUMMARY OF THE INVENTION

In view of the above, the present invention is intended to obviate the above-mentioned problems of the prior art.

An object of the present invention is to provide a superconducting solenoid and a method of making the same in which density of the current flowing through the windings can be made at a sufficiently high level, and which the size and the production cost of the solenoid can be reduced.

In order to achieve the above object, according to one aspect of the present invention, there is provided a superconducting solenoid which comprises: a plurality of coil elements each in the form of a pancake laminated one over another in concentric relation with each other, each of the coil elements including a winding frame in the form of a cylinder, and filamentary conductors wound around the winding frame and then heat treated, and a supporting structure formed of a resinous material impregnated in between the wound filamentary conductors; spacer means formed of an electrically insulating material and interposed between adjacent coil elements for providing electrical insulation and conduits for a cooling medium; and means for assembling together the laminated coil elements and the spacer means.

In a preferred embodiment, heat treatment of the filamentary conductors is effected with the filamentary conductors separated from the winding frame.

In another preferred embodiment, heat treatment of the filamentary conductors is effected with the filamentary conductors mounted on the winding frame.

It is also preferred that each of the coil elements is provided at their opposite ends with a pair of flat and smooth surfaces.

Preferably, impregnation of the resinous materials is effected by the use of a vacuum-forced impregnation process.

In a preferred embodiment, the means for assembling the laminated coil elements and the spacer means together comprises a pair of end plates disposed on the opposite ends of the laminated coil elements, a plurality of rods each being threaded at their opposite ends and extending through the end plates, and nuts adapted to be threaded on the threaded ends of each of the rods, whereby the laminated coil elements and the spacer means are clamped by the end plates.

According to another aspect of the present invention, there is provided a method of making a superconducting solenoid which comprises the steps of: forming a plurality of coil elements each in the form of a pancake by winding unreacted filamentary conductors around a winding frame in the form of a cylinder, heat-treating the filamentary conductors thus wound, and impregnating a resinous material in between the windings of the filamentary conductors to provide a supporting structure; laminating the coil elements one over another with spacer means of an electrically insulating material interposed between adjacent coil elements for providing electrical insulation and conduits for a cooling medium; and assembling together the laminated coil elements and the spacer means to provide a superconducting solenoid.

In a preferred embodiment, heat treatment of the wound filamentary conductors is effected with the filamentary conductors separated from the winding frame.

In another preferred embodiment, heat treatment of the wound filamentary conductors is effected with the filamentary conductors mounted on the winding frame.

Preferably, impregnation of the resinous material is effected by a vacuum-forced impregnation process.

The above and other objects, features and advantages of the present invention will become apparent from the following detailed description of a presently preferred embodiment of the invention when taken in conjunction with the accompanying drawings.

DESCRIPTION OF THE PREFERRED EMBODIMENT

Figure 1:
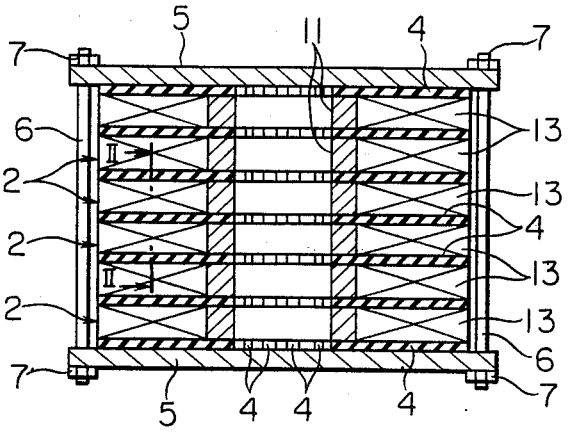
FIG. 1 is a side elevational view in cross section of a superconducting solenoid in accordance with a preferred embodiment of the present invention.

In FIG. 1, there is shown a superconducting solenoid, which is constructed in accordance with the principles of the present invention. In this Figure, the superconducting solenoid comprises a plurality of coil elements 2 each in the form of a pancake disposed one over another in concentric relation with each other, a plurality of spacer means 4 formed of an electrically insulating material and respectively interposed between two adjacent coil elements 2, and a pair of end plates 5 disposed at the upper and lower ends of the laminated coil elements 2 with spacer means 4 of an electrically insulating material respectively interposed between each end plate 5 and the uppermost or lowermost one of the coil elements 2, these end plates 5 being connected with each other by means of a plurality of rods 6 with threaded ends and nuts 7 threaded on the threaded ends of each rod so that the laminated coil elements 2 are clamped between the end plates 5.

Now, the concept of the invention and the process of making the superconducting solenoid will be described in detail.

First, according to a publication entitled Superconducting Engineering (edited by the Electrical Society of Japan, Section 3.4, "Restraints on Extensions of the Normal Conducting Portion", page 73), stability in superconductivity is expressed by the following formula.

$$I < \sqrt{\frac{2APh\theta t}{\sigma n}}$$

where A is the cross sectional area of a conductor or wire; P is the cooling area per unit length of the conductor; h is the coefficient of heat conductivity between a cooling medium and the surface of the conductor; $\theta t$ is the temperature difference between the cooling medium and the surface of the conductor; and $\sigma n$ is the resistance at normal conducting times (or portions).

Accordingly, if h, $\theta t$, and $\sigma n$ remain unchanged, the current density ($\sigma = A/I$) of the conductor is represented by the following formula.

$$\sigma \propto \sqrt{P/A}$$

Figure 2:
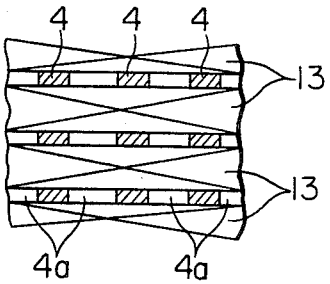
FIG. 2 is a cross section taken on the line II—II of FIG. 1.
Figure 5A:
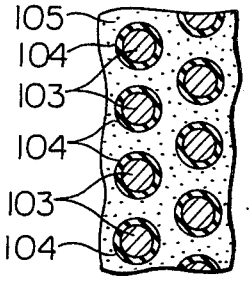
FIG. 5A is a cross section, on an enlarged scale, showing part of a winding arrangement in which wires of circular cross section are employed.
Figure 5B:
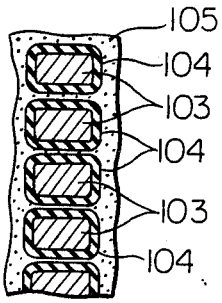
FIG. 5B is a cross section, on an enlarged scale, showing part of another winding arrangement in which wires of rectangular cross section are employed.

From this formula, it will be seen that the larger the area of the conductor in contact with the cooling medium, the smaller of the coil assembly becomes. Thus, it is preferable that the winding arrangement is such that a plurality of coil elements 2 each in the form of a pancake are laminated one over another with appropriate spacer means 4 of an electrically insulating material being interposed between adjacent coil elements 2. As best seen from FIG. 2, the spacer means 4 comprises, in the illustrated embodiment, a plurality of radially extending spacer plates each of a rectangular cross section which are disposed in circumferentially spaced apart relation at equal intervals so as to form therebetween radial coolant conduits 4*a* for a cooling medium such as liquid helium. In order to achieve such a coil arrangement by means of the "wind and react" procedure, each coil element 2 is made by the so-called "wind and react" procedure, that is the wires 103 of filamentary $Nb_3Sn$ or $V_3Ga$ conductors each enclosed with an insulator of a heat-resisting material, as illustrated in FIG. 5A or 5B, are wound around the winding frame or core 11 to form pancake-like windings 13. The windings 13 thus formed are heat treated and impregnated with a resinous material to provide a supporting structure. The respective pancake-like coil elements 2 thus formed are laminated one over another with the spacer plates 4 of electrically insulating material interposed therebetween, and assembled together by fastening means to provide a superconducting solenoid. Such fastening means comprises, in the illustrated embodiment, a pair of end plates 5 disposed at the opposite ends of the laminated coil elements 2, a plurality of rods each being threaded at their opposite ends and extending through the end plates 5, and nuts 7 adapted to be threaded on the opposite threaded ends of each rod 6.

Here, it is to be noted that in the above-described procedure, the spacers 4 and the end plates 5 are assembled at the final assembling stage and are not subjected to heat treatment so that these members are not necessarily formed of materials heat-resistant enough to withstand burning at high temperatures, but instead may be formed of materials which exhibit excellent properties only at the cryogenic temperatures created by the cooling medium.

Although in the above-described embodiment, the winding frames 11 are illustrated as being integral with the coil windings 13 each in the form of a pancake, the coil windings 13 may be separated from the winding frames 11 during heat treatment thereof and then mounted again on the winding frames 11 at the time of impregnation of resinous materials. In this way, the winding frames 11 need not be heat resistant.

Figure 3:
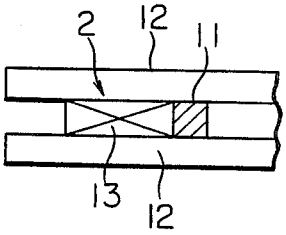
FIG. 3 is a partial cross section showing that coil windings in the form of a pancake are impregnated with a resinous material.
Figure 4:
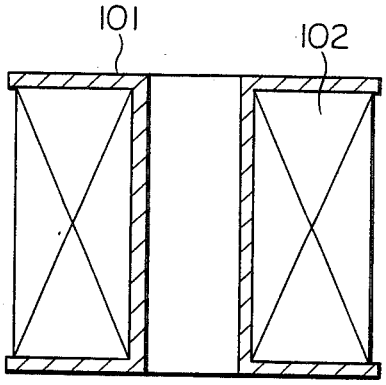
FIG. 4 is a side elevational view in cross section of a conventional superconducting solenoid.

In addition, it is preferred that impregnation of the resinous materials be effected by the use of a vacuum-forced impregnation process so as to provide a good supporting structure for the windings with inclusion of little or no voids. Moreover, it is most desirable that each of the finished pancake-like coil elements 2 have flat and smooth upper and lower surfaces. To this end, as illustrated in FIG. 3, a pair of particular guide plates 12 may be employed during impregnation which are disposed on the upper and lower surfaces of each coil element 2.

What is claimed is:

1. A superconducting solenoid comprising: a plurality of coil elements each in the form of a pancake laminated one over another in concentric relation with each other, each of said coil elements including a winding frame in the form of a cylinder, and filamentary conductors wound around said winding frame and then heat treated, and a supporting structure formed of a resinous material impregnated in between said wound filamentary conductors; spacer means formed of an electrically insulating material and interposed between adjacent coil elements for providing electrical insulation and conduits for a cooling medium; and means for assembling together said laminated coil elements and said spacers.

2. A superconducting solenoid as claimed in claim 1, wherein heat treatment of said filamentary conductors is effected with said filamentary conductors separated from said winding frame.

3. A superconducting solenoid as claimed in claim 1, wherein heat treatment of said filamentary conductors is effected with said filamentary conductors mounted on said winding frame.

4. A superconducting solenoid as claimed in claim 1, wherein each of said coil elements is provided at their opposite ends with a pair of flat and smooth surfaces.

5. A superconducting solenoid as claimed in claim 1, wherein impregnation of said resinous materials is effected by the use of a vacuum-forced impregnation process.

6. A superconducting solenoid as claimed in claim 1, wherein said means for assembling together said laminated coil elements and said spacer means comprises a pair of end plates disposed on the opposite ends of said laminated coil elements, a plurality of rods each being threaded at its opposite ends and extending through said end plates, and nuts adapted to be threaded on the threaded ends of each of said rods, whereby said laminated coil elements and said spacer means are clamped by said end plates.

7. A method of making a superconducting solenoid comprising the steps of: forming a plurality of coil elements each in the form of a pancake by winding unreacted filamentary conductors around a winding frame in the form of a cylinder, heat-treating the filamentary conductors thus wound, and impregnating a resinous material in between the windings of said filamentary conductors to provide a supporting structure; laminating said coil elements one over another with spacer means of an electrically insulating material interposed between adjacent coil elements for providing electrical insulation and conduits for a cooling medium; and assembling together said laminated coil elements and said spacer means to provide a superconducting solenoid.

8. A method of making a superconducting solenoid as claimed in claim 7, wherein heat treatment of said wound filamentary conductors is effected with said filamentary conductors separated from said winding frame.

9. A method of making a superconducting solenoid as claimed in claim 7, wherein heat treatment of said wound filamentary conductors is effected with said filamentary conductors mounted on said winding frame.

10. A method of making a superconducting solenoid as claimed in claim 7, wherein impregnation of said resinous material is effected by a vacuum-forced impregnation.

* * * * *